US009196977B2

(12) United States Patent
Perez, Jr.

(10) Patent No.: US 9,196,977 B2
(45) Date of Patent: Nov. 24, 2015

(54) APPARATUS FOR USE IN WIRING A MULTI-CONFIGURABLE ELECTRICAL DEVICE DURING INSTALLATION THEREOF AT A POINT OF OPERATION

(71) Applicant: CONSERT INC., San Antonio, TX (US)

(72) Inventor: Erasmo Perez, Jr., San Antonio, TX (US)

(73) Assignee: Consert Inc., San Antonio, TX (US)

( * ) Notice: Subject to any disclaimer, the term of this patent is extended or adjusted under 35 U.S.C. 154(b) by 174 days.

(21) Appl. No.: 13/954,151

(22) Filed: Jul. 30, 2013

(65) Prior Publication Data

US 2015/0037992 A1 Feb. 5, 2015

(51) Int. Cl.
*H01R 3/00* (2006.01)
*H01R 9/24* (2006.01)

(52) U.S. Cl.
CPC ..... *H01R 9/2475* (2013.01)

(58) Field of Classification Search
CPC ..... H01R 9/24; H01R 4/34
USPC ..... 439/217, 404, 488, 222–224, 491, 713, 439/718; 174/112, 135, 254, 267; 236/1 C, 236/51
See application file for complete search history.

(56) References Cited

U.S. PATENT DOCUMENTS 1,936,963 A * 11/1933 Dutzmann ..... H01R 9/26 324/74
2,125,256 A * 7/1938 Fairbanks ..... H01R 4/489 200/16 E
2,671,888 A * 3/1954 Hadden ..... H01R 9/2475 439/713
2,727,966 A * 12/1955 Reichert ..... H01H 9/0264 200/304
2,848,703 A * 8/1958 Foote ..... H01R 9/2475 439/491
3,235,797 A * 2/1966 Boscia ..... G01R 31/2601 324/537
3,860,314 A * 1/1975 Vandiveer ..... H01R 9/24 439/54
3,945,706 A * 3/1976 Steiner ..... G09F 3/06 439/491
3,989,338 A * 11/1976 Gosser ..... H01R 13/465 174/112
4,479,317 A * 10/1984 Hanna ..... H01H 9/18 439/491
4,637,676 A * 1/1987 Simonsen ..... H01R 9/2683 439/488
4,697,720 A * 10/1987 Hotchkiss ..... H01R 4/2429 174/138 F
4,700,384 A * 10/1987 Meyer ..... H04M 1/0293 174/60
4,714,434 A * 12/1987 Norden ..... 439/488
4,820,193 A * 4/1989 Noorily ..... 439/488
5,613,874 A * 3/1997 Orlando ..... H01R 13/465 40/607.13
6,102,749 A * 8/2000 Lynn et al. ..... 439/810
6,122,160 A * 9/2000 Hannula ..... 361/600
6,281,695 B1 * 8/2001 Chung ..... G01R 1/0408 439/491

(Continued)

*Primary Examiner* — Amy Cohen Johnson
*Assistant Examiner* — Milagros Jeancharles
(74) *Attorney, Agent, or Firm* — Daniel C. Crilly; GrayRobinson, P.A.

(57) ABSTRACT

An apparatus for use in wiring a multi-configurable electrical device during installation thereof at point of operation includes a substrate defining a plurality of tabs separated by at least one gap. The tabs and the gap or gaps are arranged such that when the substrate is positioned proximate the electrical device, the tabs cover a first group of one or more wiring terminals of the electrical device and the gap or gaps provides access to a second group of one or more wiring terminals of the electrical device in accordance with a first wiring configuration of a plurality of possible wiring configurations. According to one exemplary embodiment, the substrate is generally rectangular and non-conductive. Visible indicia may be optionally disposed on the substrate (e.g., by adhering a label containing the indicia to the substrate) to provide information relating to wiring the electrical device according to the first wiring configuration.

20 Claims, 5 Drawing Sheets

(56) References Cited

U.S. PATENT DOCUMENTS 6,497,592 B1 * 12/2002 Beadle ..... H01R 9/2425 439/718
6,789,739 B2 * 9/2004 Rosen ..... 236/51
6,916,211 B2 * 7/2005 Price ..... G09B 23/181 439/697
7,134,921 B2 * 11/2006 Siracki ..... H01R 4/305 439/718
7,297,019 B2 * 11/2007 Landis et al. ..... 439/491
7,410,386 B2 * 8/2008 Fabian et al. ..... 439/441
7,527,523 B2 * 5/2009 Yohn ..... H01R 4/30 439/564
7,558,648 B2 * 7/2009 Hoglund et al. ..... 700/277
7,942,679 B1 * 5/2011 Gretz ..... H01R 4/36 439/108
8,221,157 B2 * 7/2012 Zantout ..... H01R 9/2475 439/491
8,727,818 B2 * 5/2014 Kossak ..... H01R 4/34 439/718
2009/0140065 A1 * 6/2009 Juntunen et al. ..... 236/1 C

* cited by examiner

--PRIOR ART--

APPARATUS FOR USE IN WIRING A MULTI-CONFIGURABLE ELECTRICAL DEVICE DURING INSTALLATION THEREOF AT A POINT OF OPERATION

BACKGROUND

1. Field of the Invention

The present invention relates generally to installing electrical devices, such as thermostats, at points of operation and, more particularly, to an apparatus for aiding an installer in properly wiring an electrical device where the electrical device is capable of multiple wiring configurations.

2. Description of Related Art

Electrical service points, such as residential, commercial, industrial, and agricultural properties, include a variety of different systems that use utility-supplied and/or locally-generated alternating current electrical power. Such systems include, for example, heating, ventilation, and air conditioning (HVAC) systems, sprinkler systems, lighting systems, aquatic systems (e.g., pools and fountains), industrial systems, and surveillance systems, just to name a few. Many of these systems include electrical control devices, which control when the systems turn on and off. For example, an HVAC system typically includes one or more thermostats that control when the system's air conditioning compressor, fan motor, heat pump, furnace, or heating element, as applicable, turns on and off based on temperature set points stored in each thermostat (an HVAC system may include multiple thermostats where the system has multiple heating/cooling zones or where the system includes separate thermostats for heating and cooling). Additionally, a lighting system typically includes one or more timers, optical sensors, and/or motion sensors that control when the illumination elements (e.g., lamps, lights, or bulbs) turn on and off. Further, a sprinkler system typically includes one or more timers and/or rain sensors that control when the sprinkler pump motor turns on and off.

Nowadays, many electrical devices used to control service point systems are flexibly designed to work with a variety of different systems. For example, some thermostats are designed to be used with just about any HVAC system, whether conventional furnace or heat pump, 4-wire or 5-wire, single stage heat/cool or multi-stage heat/cool, or electric or natural gas. One such thermostat is the model CT30 wireless thermostat, which is commercially available from Radio Thermostats of America of San Francisco, Calif. An exemplary illustration of a wiring terminal panel for such a wireless thermostat 100 is shown in FIG. 1.

As illustrated, the thermostat 100 includes a housing 101, several exposed wiring terminals 103-113, two setting switches 115, 117, and a reset switch 119. The settings of the setting switches 115, 117 and the installation of wires into the wiring terminals 103-113 (i.e., the wiring configuration) depends on the particular type of HVAC system to be controlled by the thermostat 100. For example, when the HVAC system is a conventional, 4-wire, electric system, the normal/HP setting switch 115 should be set to "NORM", the gas/electric setting switch 117 should be set to "ELEC", the blue common wire from the HVAC system should be installed into the "C" wiring terminal 103, the white "heat" control wire for the HVAC system should be installed in the "W" wiring terminal 106, the yellow "cool" control wire for the HVAC system should be installed in the "Y" wiring terminal 108, the red +24 Volt wire from the HVAC system should be installed in the "RC" wiring terminal 111, and the green "fan" wire for the HVAC system should be installed in the "G" wiring terminal 112. Alternatively, as another example, when the HVAC system is a 5-wire heat pump system with auxiliary heat, the normal/HP setting switch 115 should be set to "HP", the gas/electric setting switch 117 should be set to "ELEC" or "GAS", as applicable, the blue common wire from the HVAC system should be installed into the "C" wiring terminal 103, the orange "reversing valve" control wire for the HVAC system should be installed in the "B" wiring terminal 104, the black "auxiliary heat" wire should be installed in the "W2" wiring terminal 107, the yellow "cool" control wire for the HVAC system should be installed in the "Y" wiring terminal 108, the red +24 Volt wire from the HVAC system should be installed in the "RC" wiring terminal 111, and the green "fan" wire for the HVAC system should be installed in the "G" wiring terminal 112. Thus, while some of the thermostat wiring for the two exemplary HVAC systems is the same, some is also different, resulting in two distinct wiring configurations.

Due to the various possible wiring configurations for some electrical devices, miswiring mistakes occasionally occur during installation of such devices at their respective points of operation. Such miswiring can result in safety issues, defective operation or failure of the system controlled by the miswired electrical device, and/or damage to the electrical device. Therefore, a need exists for a tool which can be used by installers, service technicians, and/or end users to mitigate the likelihood of miswiring mistakes during installation and/or servicing of electrical devices, where such electrical devices are capable of being wired in any one of multiple wiring configurations.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

Figure 1:
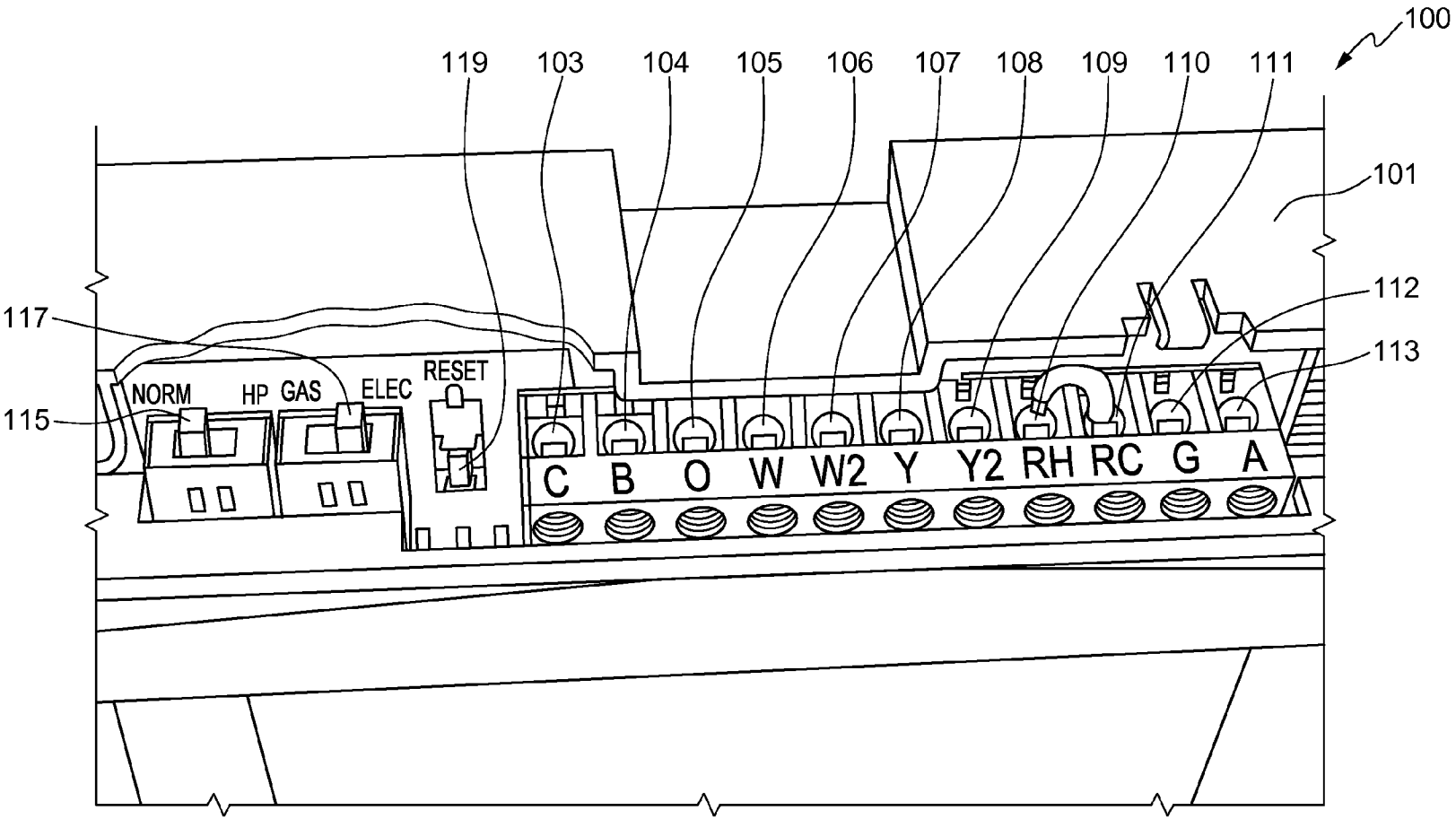
FIG. 1 illustrates an exemplary wiring panel, including exposed setting switches and wiring terminals, for a conventional wireless thermostat that is installable at a point of operation.

Skilled artisans will appreciate that elements in the figures are illustrated for simplicity and clarity and have not necessarily been drawn to scale. For example, the dimensions of some of the elements in the figures may be exaggerated alone or relative to other elements to help improve the understanding of the various embodiments of the present invention.

DETAILED DESCRIPTION

Generally, the present invention encompasses an apparatus for use in wiring an electrical device during installation or servicing thereof at a point of operation, where the electrical device is capable of being wired in any one of multiple different wiring configurations. According to one embodiment, the apparatus includes a substrate defining a plurality of tabs separated by one or more gaps. The tabs and the gap or gaps are arranged such that when the substrate is positioned proximate the electrical device, the tabs cover a first group of one or more wiring terminals of the electrical device and the gap or gaps provide access to a second group of one or more wiring terminals of the electrical device in accordance with a particular one of the wiring configurations for the electrical device. For example, where the electrical device is a remotely controllable thermostat, the particular wiring configuration may correspond to a wiring configuration for a heating, ventilation, and air conditioning (HVAC) system located at the point of operation. Thus, the apparatus provides a guide or key for an installer or service technician to use to mitigate the likelihood that the electrical device will be miswired during installation or servicing.

In an alternative embodiment, the apparatus may further include visible indicia disposed on the substrate, which provides information relating to wiring the electrical device according to the particular wiring configuration. For example, the indicia may identify which wires should be passed through the gaps so as to properly wire the electrical device for the particular wiring configuration identified by the indicia. The indicia may be printed, screened, embossed, molded, etched, or engraved directly onto the apparatus, or may be printed on one or more labels that are adhered to the substrate. Where the substrate is generally planar, the indicia may be disposed on one or both sides of the substrate (e.g., with wiring indicia on one side and explanatory information on the other side).

In a further alternative embodiment, the substrate may include multiple sets of tabs and gaps along two or more edges of the substrate to enable the apparatus to serve as an aid for wiring the electrical device in multiple different wiring configurations. For example, in one particular embodiment, a first set of tabs and gaps may be arranged along one edge of the substrate so as to facilitate one particular wiring configuration for the electrical device and a second set of tabs and gaps may be arranged along an opposing edge of the substrate so as to facilitate a different wiring configuration for the electrical device. In this case, when a visible indicia is disposed on the substrate, such indicia may provide information relating to wiring the electrical device according to both particular wiring configurations, with appropriate information for each wiring configuration being oriented so as to be readable by the installer or service technician when the apparatus is properly oriented to wire the electrical device according to the particular wiring configuration.

According to another alternative embodiment, an apparatus for use in wiring an electrical device during installation thereof at a point of operation includes a non-conductive substrate defining a plurality of tabs separated by one or more gaps. The tabs and the gap or gaps are arranged such that when the substrate is positioned proximate the electrical device, the tabs cover a first group of one or more wiring terminals of the electrical device and the gap or gaps provide access to a second group of one or more wiring terminals of the electrical device in accordance with a particular one of the wiring configurations for the electrical device. In this embodiment, the apparatus additionally includes visible indicia disposed on the substrate and providing information relating to wiring the electrical device according to the particular wiring configuration.

According to a further embodiment of the present invention, an apparatus for use in wiring an electrical device during installation thereof at a point of operation includes a generally rectangular, non-conductive substrate defining a first plurality of tabs along a first edge of the substrate and a second plurality of tabs along a second edge of the substrate. Each set of tabs are separated by a respective plurality of gaps such that each gap is defined by a distance separating a corresponding pair of tabs. The tabs and gaps along the first edge of the substrate are arranged such that when the first edge of the substrate is positioned proximate the electrical device, the first set of tabs cover a first group of one or more wiring terminals of the electrical device and the gaps provide access to a second group of one or more wiring terminals of the electrical device in accordance with a first wiring configuration for the electrical device. The tabs and gaps along the second edge of the substrate are arranged such that when the second edge of the substrate is positioned proximate the electrical device, the second set of tabs cover a third group of one or more wiring terminals of the electrical device and the gaps provide access to a fourth group of one or more wiring terminals of the electrical device in accordance with a second wiring configuration for the electrical device. In this embodiment, the apparatus additionally includes visible indicia disposed on the substrate, which provides information relating to wiring the electrical device according to the first and second wiring configurations.

By providing a wiring guide key or other similar apparatus in this manner, the present invention provides a useful aid to electrical device installers and service technicians to mitigate the likelihood that electrical devices are miswired during installation or servicing when such devices are capable of multiple different (sometimes only slightly different) wiring configurations. In other words, by positioning the apparatus of the present invention proximate the wiring panel of the electrical device, the installer or service technician can insure that the correct wires are installed in their corresponding wiring terminals of the electrical device, thereby rendering the electrical device properly functional in accordance with the wiring configuration facilitated by the wiring guide apparatus.

Figure 2:
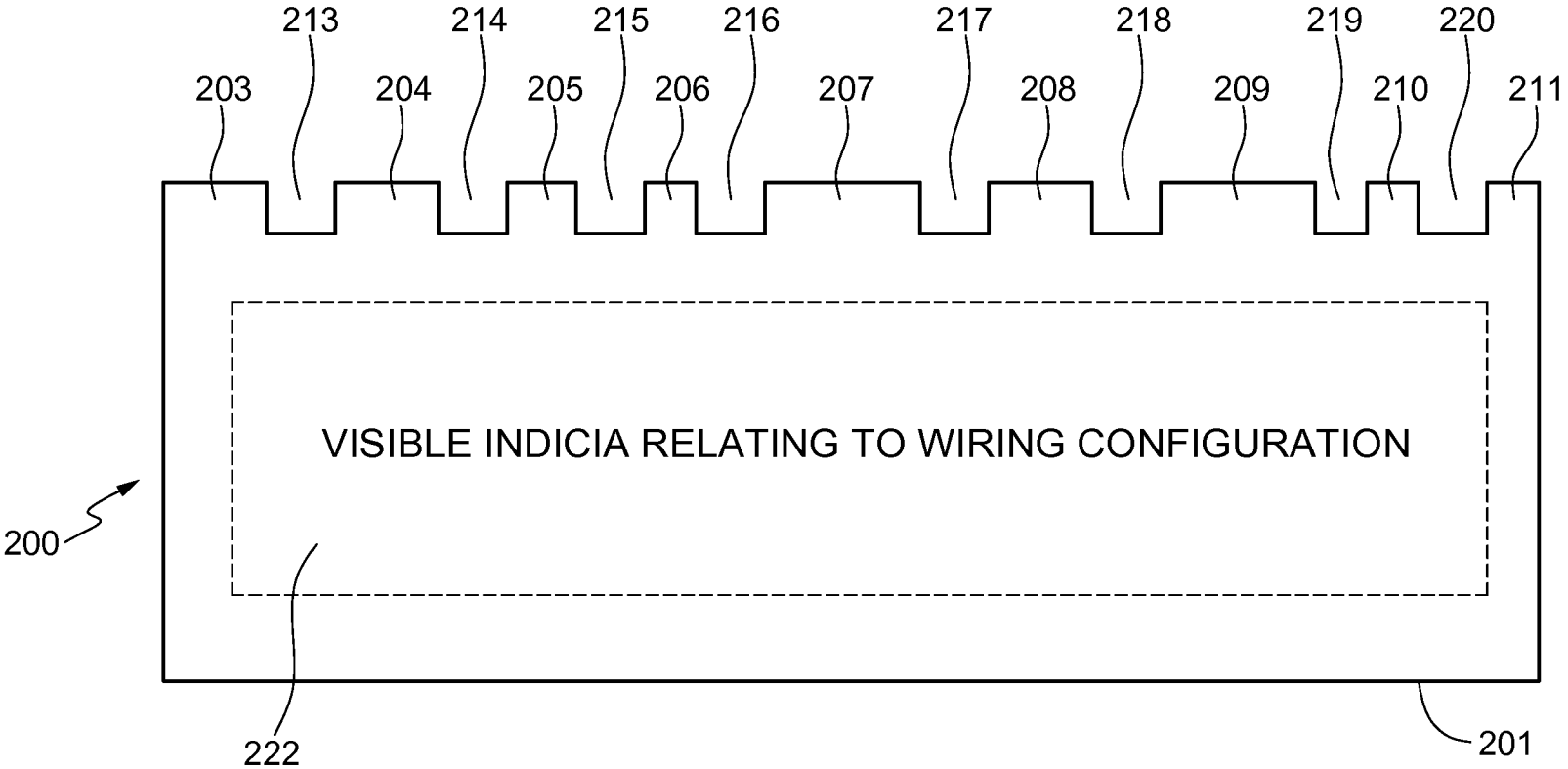
FIG. 2 illustrates an apparatus for use in wiring a multi-configurable electrical device during installation of the electrical device at a point of operation, in accordance with an exemplary embodiment of the present invention.

Embodiments of the present invention can be more readily understood with reference to FIGS. 2-5, in which like reference numerals designate like items. FIG. 2 illustrates an apparatus 200 for use in wiring a multi-configurable electrical device during installation of the electrical device at a point of operation, in accordance with an exemplary embodiment of the present invention. The electrical device may be a remotely controllable, wireless thermostat 100, such as the CT30 wireless thermostat that is commercially available from Radio Thermostat Company of America of San Francisco, Calif. (http://www.radiothermostat.com). Alternatively, the electrical device may be a conventional thermostat, a heat pump thermostat, or any other electrical device that is capable of being wired in different configurations based on its intended use.

According to the exemplary embodiment illustrated in FIG. 2, the apparatus 200 includes a substrate 201 defining a plurality of tabs 203-211 separated by at least one gap 213-220. The embodiment depicted in FIG. 2 includes nine tabs 203-211 and eight gaps 213-220. However, those of ordinary skill in the art will readily recognize and appreciate that the quantity of tabs and gaps depends upon the desired wiring configuration for the electrical device for which the apparatus 200 is to act as a guide or key. Each gap 213-220 of the apparatus 200 is defined by the distance separating a corresponding pair of tabs that adjoin the gap 213-220. For example, gap 213 is defined by the distance separating adjoining tabs 203 and 204; whereas, gap 219 is defined by the distance separating adjoining tabs 209 and 210. As illustrated in FIG. 2, the tabs 203-211 and gaps 213-220 can have varying widths as necessary to enable the tabs 203-211 to cover a first group of wiring terminals of the electrical device and the gaps 213-220 to expose or provide access to a second group of wiring terminals of the electrical device when the substrate 200 is positioned proximate (e.g., adjacent) the electrical device, in accordance with a particular wiring configuration.

In an alternative embodiment, the apparatus 200 may optionally include visible indicia 222 disposed on the substrate 201. In such a case, the indicia 222 may provide information relating to wiring the electrical device according to a particular wiring configuration facilitated by the arrangement of tabs 203-211 and gaps 213-220. The visible indicia 222 may be printed on one or more labels adhered to the substrate 201. For example, the label or labels may be pre-printed with the indicia 222 and then secured to the substrate 201. Alternatively, the visible indicia 222 may be printed, screened, stamped, embossed, etched, engraved, or otherwise disposed on the substrate 201 directly or on a carrier layer or sheet that is adhered to the substrate 201.

In yet another embodiment, the visible indicia 222 may be disposed on front and back sides of the substrate 201, instead of on just the front side as illustrated in FIG. 2. For example, the visible indicia 222 on the front side of the substrate 201 may identify the wiring configuration supported by the apparatus 200 using shorthand, symbols, and/or color coded information, and the indicia on the back side of the substrate 201 may provide explanations for the shorthand, symbols, and/or color coding. An example of visible indicia 222 provided on both sides of the substrate 201 is described below with respect to FIGS. 3 and 4.

The substrate 201 may be any size and have any geometry as may be necessary to meet the installation requirements of the associated electrical device. However, in one embodiment in which the apparatus 200 is intended to be used with a thermostat, the substrate 201 is generally rectangular, approximately credit card-sized, and fabricated from a generally rigid, non-conductive, non-flammable material, such as plastic, rubber, resin, laminate, or composite (e.g., fiberglass). Alternatively, the substrate 201 may be fabricated from other non-conductive or semi-conductive materials, such as printed circuit board materials (e.g., polytetrafluoroethylene, polyimide, cyanate ester, FR-4) or cardboard. The gaps 213-220 of the substrate 201 may be fabricated using any conventional cutting or scoring device, such as a router, saw, punch, scissors, or rotary hand tool (e.g., a Dremel tool).

Figure 3:
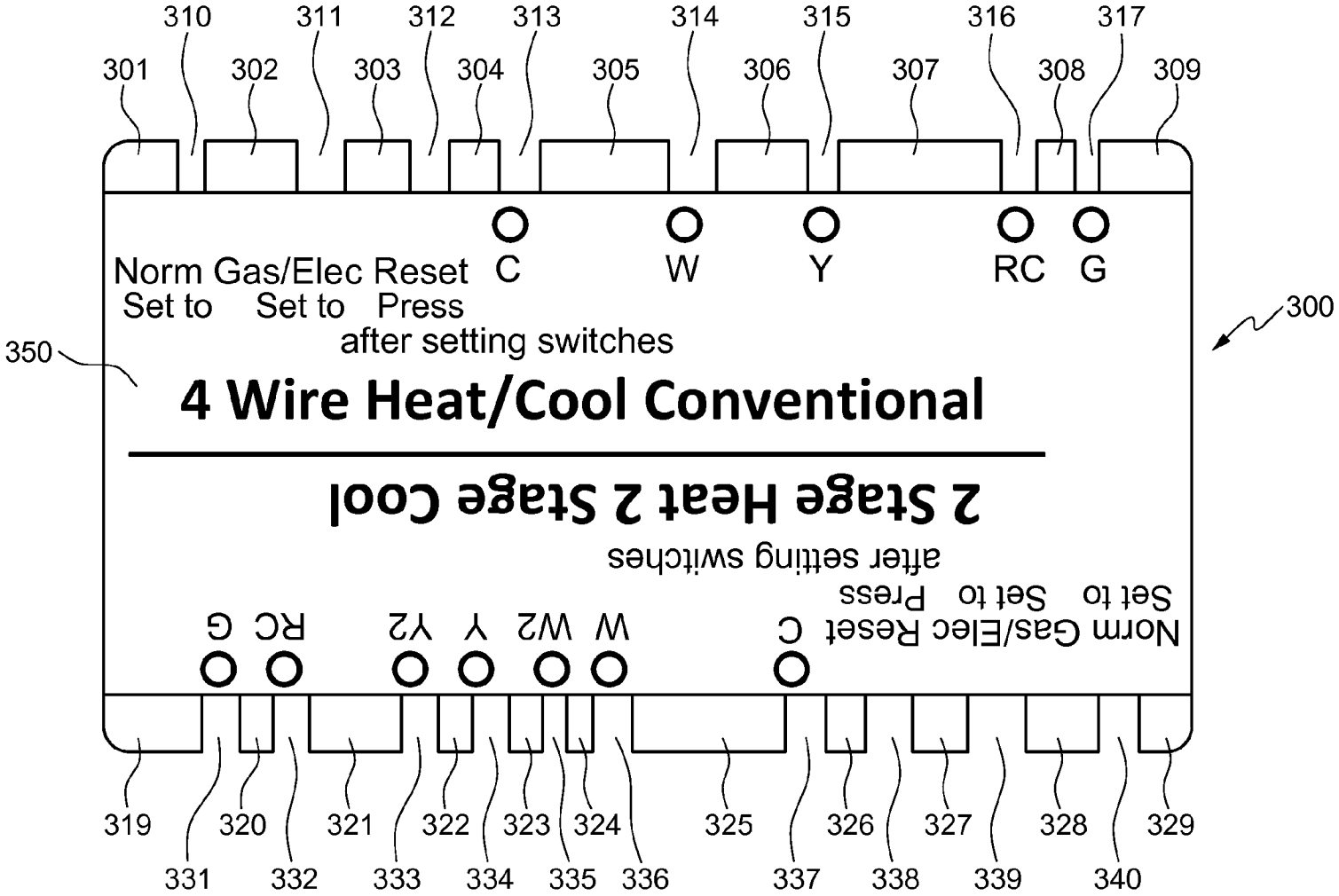
FIG. 3 illustrates a front view of an apparatus for use in wiring a thermostat during installation of the thermostat at a point of operation, where the thermostat is capable of multiple wiring configurations, in accordance with an alternative exemplary embodiment of the present invention.
Figure 4:
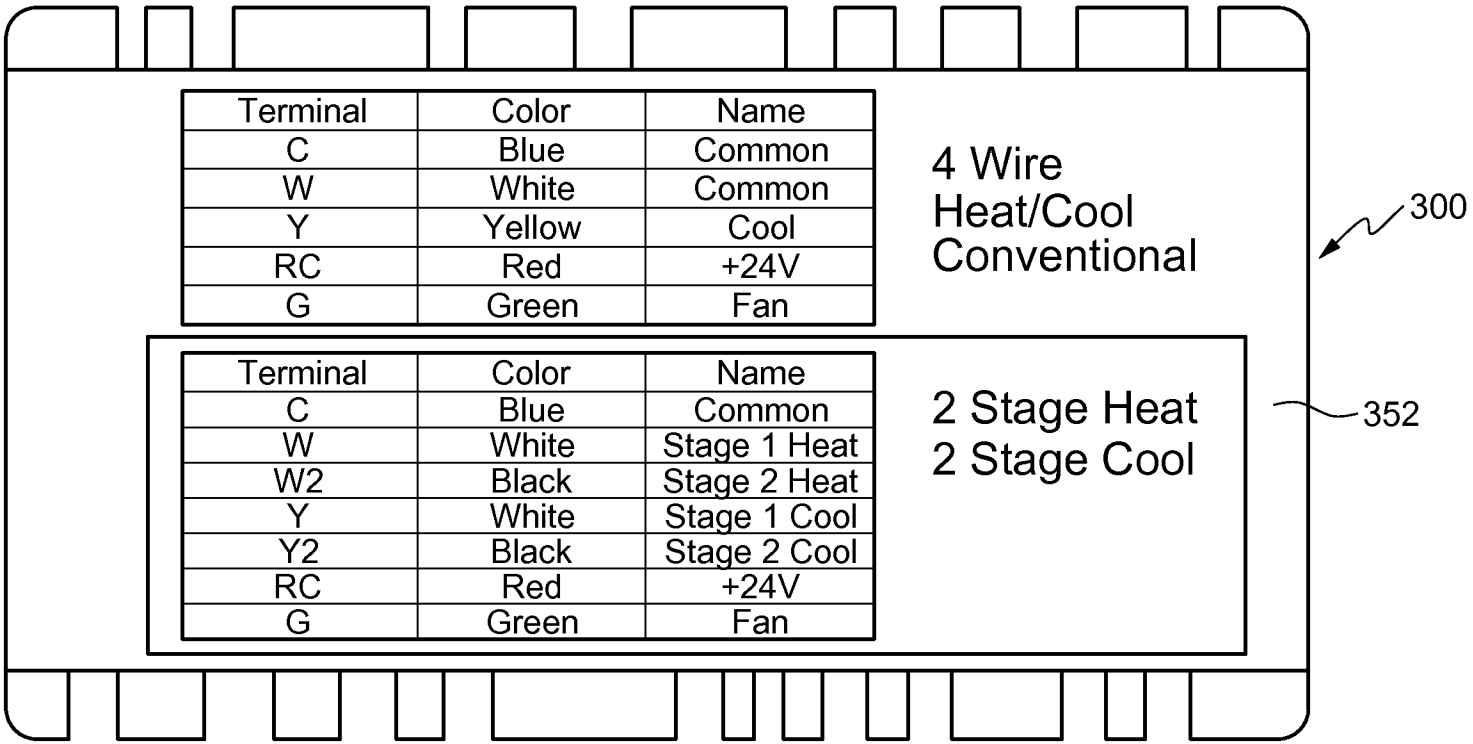
FIG. 4 illustrates a rear view of the apparatus of FIG. 3 showing additional visible information that may be optionally displayed on a second label adhered to the apparatus' substrate.

The embodiment depicted in FIG. 2 shows an apparatus 200 with tabs 203-211 and gaps 213-220 along one edge of the substrate 201 only. In an alternative embodiment, tabs and gaps may be formed on multiple edges of the apparatus 200. One exemplary apparatus 300 with tabs and gaps on two opposing edges of a substrate is illustrated in FIGS. 3 and 4. In particular, FIG. 3 illustrates a front view of the alternative apparatus 300 and FIG. 4 illustrates a back or rear view of the alternative apparatus 300. The apparatus 300 illustrated in FIGS. 3 and 4 may be used as an aid or key for wiring a thermostat during installation at a point of operation, such as a commercial, residential, agricultural, industrial, or other property. The thermostat or other device with which the apparatus 300 may be used is capable of being wired in one of multiple wiring configurations.

For a multi-configurable thermostat, the particular wiring configuration to be used depends upon the type of HVAC system installed at the property. For example, the visible indicia 350, 352 present on the front and back sides of the exemplary installation guide apparatus 300 illustrated in FIGS. 3 and 4 indicates that the apparatus 300 may be used for wiring a thermostat that controls either a 4-wire heat/cool conventional HVAC system or a 2-stage heat, 2-stage cool HVAC system. Thus, the tabs 301-309 and gaps 310-317 along the top edge of the apparatus 300 correspond to wiring the thermostat for use with a 4-wire heat/cool conventional HVAC system and the tabs 319-329 and gaps 331-340 along the bottom edge of the apparatus 300 correspond to wiring the thermostat for use with a 2-stage heat, 2-stage cool HVAC system.

In the embodiment illustrated in FIGS. 3 and 4, the two sets of tabs and gaps are arranged along edges of the substrate that are separated approximately by a width of the substrate. However, depending on the size of the substrate, the sets of tabs and gaps may be incorporated into or added onto all edges of the substrate, along adjacent edges of the substrate, or along edges of the substrate that are separated approximately by a length of the substrate. Along any particular edge of the substrate, the gaps along the particular edge are defined by the distances separating adjoining pairs of tabs along the same edge (e.g., gap 315 is defined by the distance separating tabs 306 and 307; whereas, gap 333 is defined by the distance separating tabs 321 and 322). Each gap is generally sized and shaped to permit a wire to pass through the gap to access a wiring terminal of the electrical device over which the gap is positioned during use of the apparatus 300. The gaps 213-220, 331-340 illustrated in FIGS. 2 and 3 are generally rectangular shaped, but other shapes may be used also or instead.

Several different apparatuses implemented in accordance with the present invention may be possessed by an electrical device installer or service technician to account for all of the different possible wiring configurations of one or more electrical device installed or encountered by the installer or technician. As one example, each apparatus may include tabs and gaps, as well as optional visible indicia, for two different wiring configurations. Therefore, if a particular electrical device has six possible wiring configurations, three apparatuses (keys) may be fabricated for the particular electrical device and carried by an installer or technician, with each apparatus facilitating a pair of wiring configurations for the electrical device.

Similar to the visible indicia 222 described above with respect to FIG. 2, the visible indicia 350, 352 on the front and back sides of the substrate in the apparatus 300 of FIGS. 3 and 4 may be printed on a single label. However, in this case, the label may wrap around the substrate such that indicia 350 is on the front side of the substrate and indicia 352 is on the back side of the substrate. Alternatively, indicia 350 may be printed on one label adhered to the front side of the substrate and indicia 352 may be printed on another label adhered to the back side of the substrate. Still further, the indicia may be printed, screened, stamped, embossed, etched, engraved, or otherwise disposed on the substrate directly or on a carrier layer or sheet that is adhered to the substrate. With respect to the apparatus 300 illustrated in FIGS. 3 and 4, the visible indicia 350 on the front side of the substrate identifies the wiring configurations supported by the apparatus 300 and may use certain shorthand and symbols to do so, and the indicia 352 on the back side of the substrate may provide explanations for the shorthand and symbols. Where color coding is also used as part of the front side indicia 350, such color coding may be defined or explained within the back side indicia 352, as shown in exemplary fashion in FIG. 4.

Figure 5:
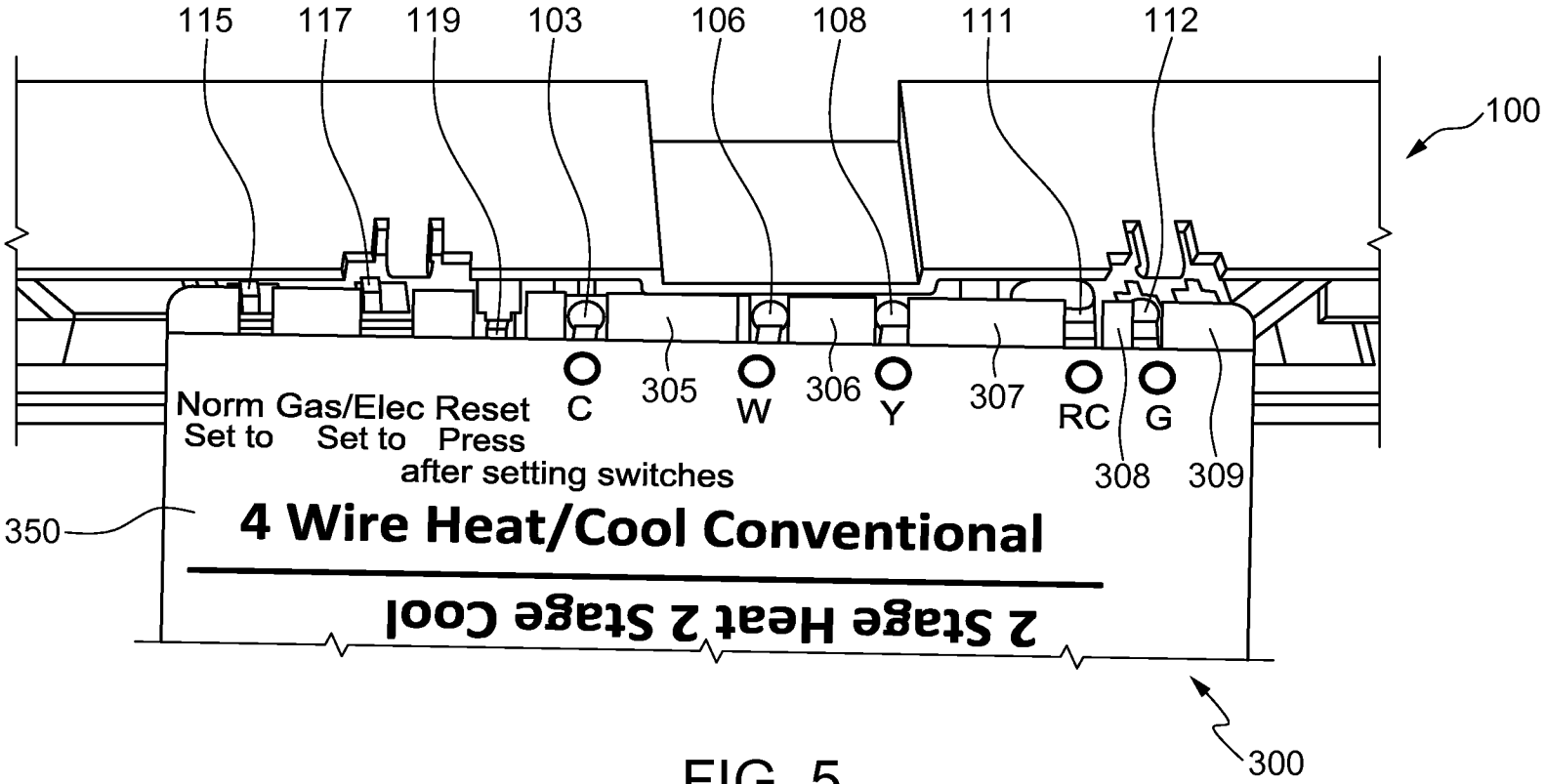
FIG. 5 illustrates use of the apparatus of FIG. 3 for wiring the wireless thermostat of FIG. 1 according to a particular exemplary wiring configuration, in accordance with an exemplary embodiment of the present invention.

FIG. 5 illustrates use of the guide apparatus 300 of FIG. 3 for wiring the wireless thermostat 100 of FIG. 1 according to a particular exemplary wiring configuration (e.g., the wiring configuration for a 4-wire heat/cool conventional HVAC system). As illustrated in FIG. 5, the guide apparatus 300 is positioned proximate (e.g., adjacent) the wiring board of the thermostat 100 such that at least some of the gaps 313-317 expose and provide access to one group of wiring terminals 103, 106, 108, 111, 112, while at least some of the tabs 305-309 cover another group of wiring terminals 104, 105, 107, 109, 110, 113. The wiring terminals 103, 106, 108, 111, 112 exposed by the gaps 313-317 are used for the particular wiring configuration; whereas, the wiring terminals 104, 105, 107, 109, 110, 113 covered by the tabs 305-309 are not. Some of the gaps 310-312 may provide access to switches (e.g., NORM/HP switch 115 and GAS/ELEC switch 117) or buttons (e.g., reset button 119) in specific or adjustable positions, as desired by the designer of the apparatus 300 for purposes of configuring the electrical device in accordance with the particular wiring configuration. Where the apparatus 300 includes visible indicia 350, such indicia 350 may provide information relating to wiring the thermostat 100 according to the particular wiring configuration, including indicating how the switches 115, 117 and reset button 119 should be set, as well as indicating or identifying which wiring terminals 103, 106, 108, 111, 112 are exposed. The installer or technician need simply wire the electrical device 100 as permitted by the installation guide 300 to properly wire the electrical device for the particular wiring configuration.

The present invention encompasses an apparatus for use in wiring an electrical device during installation or servicing thereof at a point of operation, where the electrical device is capable of being wired in any one of multiple different wiring configurations. Through use of the present invention, only those wiring terminals required for a particular wiring configuration are exposed for wiring by the installer or technician. Most or all of the remaining wiring terminals of the multi-configurable electrical device are covered up by the tabs of the apparatus. As a result, a device installer or service technician who uses the present invention is much less likely to miswire the electrical device during installation or servicing at a point of operation.

As detailed above, embodiments of the present invention reside primarily in the construction and use of an apparatus to aid installers and service technicians in wiring multi-configurable electrical devices. Accordingly, the apparatus components have been represented, where appropriate, by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as "first" and "second," "top" and "bottom," and the like may be used solely to distinguish one object or action from another object or action without necessarily requiring or implying any actual relationship or order between such objects or actions. The terms "includes," "comprises," "has," "including," "comprising," "having," and any other variations thereof are intended to cover a non-exclusive inclusion, such that a process, method, article, or apparatus that includes, comprises, or has a list of elements does not include only those elements but may include other elements not expressly listed or inherent to such process, method, article, or apparatus. The phrase "plurality of" or the term "multiple" as used in connection with any object or action means two or more of such object or action. The term "gap" should be construed broadly to encompass any aperture, opening, hole, or other access path through a thickness of the apparatus' substrate. The term "tab" should also be broadly construed to encompass any protrusion, nub, extension, or other area forming part of or emanating from the substrate and which may be used to cover a wiring terminal of an electrical device with which the apparatus is used. A claim element proceeded by the article "a" or "an" does not, without more constraints, preclude the existence of additional identical elements in the process, method, article, or apparatus that includes the element.

In the foregoing specification, specific embodiments of the present invention have been described. However, one of ordinary skill in the art will appreciate that various modifications and changes can be made without departing from the scope of the present invention as set forth in the claims below. For example, while the foregoing description has focused on particular exemplary apparatuses 200, 300 for use with a particular multi-configurable electrical device (e.g., a thermostat), those of ordinary skill in the art will readily recognize and appreciate that the gaps and tabs of an apparatus substrate may be configured in any manner to facilitate a particular wiring configuration desired for any chosen multi-configurable electrical device. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as critical, required, or essential features or elements of any or all the claims.

What is claimed is:

1. An apparatus for use in wiring a physically separate electrical device during installation thereof at a point of operation, wherein the electrical device is capable of being wired in any one of a plurality of different wiring configurations, the apparatus comprising:

a portable substrate defining a plurality of tabs separated by at least one gap, the plurality of tabs and the at least one gap being arranged such that when the substrate is positioned proximate the electrical device, the plurality of tabs cover a first group of one or more wiring terminals of the electrical device and the at least one gap provides access to a second group of one or more wiring terminals of the electrical device in accordance with a first wiring configuration of the plurality of wiring configurations.

2. The apparatus of claim 1, further comprising:

visible indicia disposed on the substrate and providing information relating to wiring the electrical device according to the first wiring configuration.

3. The apparatus of claim 2, wherein the visible indicia is printed on at least one label that is adhered to the substrate.

4. The apparatus of claim 1, wherein the at least one gap comprises a plurality of gaps and wherein each gap of the plurality of gaps is defined by a distance separating a corresponding pair of the plurality of tabs.

5. The apparatus of claim 1, wherein the electrical device is a remotely controllable thermostat and wherein the first wiring configuration corresponds to a wiring configuration for a heating, ventilation, and air conditioning system located at the point of operation.

6. The apparatus of claim 1, wherein the substrate is non-conductive.

7. The apparatus of claim 1, wherein the plurality of tabs are positioned along a first edge of the substrate, the substrate further including:

a second plurality of tabs separated by at least a second gap, the second plurality of tabs and the at least a second gap being positioned along a second edge of the substrate and arranged such that when the second edge of the substrate is positioned proximate the electrical device, the second plurality of tabs cover a third group of one or more wiring terminals of the electrical device and the at least a second gap provides access to a fourth group of one or more wiring terminals of the electrical device in accordance with a second wiring configuration of the plurality of wiring configurations.

8. The apparatus of claim 7, further comprising:

visible indicia disposed on the substrate and providing information relating to wiring the electrical device according to the first wiring configuration and the second wiring configuration.

9. The apparatus of claim 8, wherein the visible indicia is printed on at least one label that is adhered to the substrate.

10. The apparatus of claim 7, wherein the first edge of the substrate and the second edge of the substrate are opposite one another and separated by a width of the substrate.

11. An apparatus for use in wiring a physically separate electrical device during installation thereof at a point of operation, wherein the electrical device is capable of being wired in any one of a plurality of different wiring configurations, the apparatus comprising:

a portable, non-conductive substrate defining a plurality of tabs separated by at least one gap, the plurality of tabs and the at least one gap being arranged such that when the substrate is positioned proximate the electrical device, the plurality of tabs cover a first group of one or more wiring terminals of the electrical device and the at least one gap provides access to a second group of one or more wiring terminals of the electrical device in accordance with a first wiring configuration of the plurality of wiring configurations; and visible indicia disposed on the substrate and providing information relating to wiring the electrical device according to the first wiring configuration.

12. The apparatus of claim 11, wherein the visible indicia is printed on at least one label that is adhered to the substrate.

13. The apparatus of claim 11, wherein the at least one gap comprises a plurality of gaps and wherein each gap of the plurality of gaps is defined by a distance separating a corresponding pair of the plurality of tabs.

14. The apparatus of claim 11, wherein the electrical device is a remotely controllable thermostat and wherein the first wiring configuration corresponds to a wiring configuration for a heating, ventilation, and air conditioning system located at the point of operation.

15. The apparatus of claim 11, wherein the plurality of tabs are positioned along a first edge of the substrate, the substrate further including:

a second plurality of tabs separated by at least a second gap, the second plurality of tabs and the at least a second gap being positioned along a second edge of the substrate and arranged such that when the second edge of the substrate is positioned proximate the electrical device, the second plurality of tabs cover a third group of one or more wiring terminals of the electrical device and the at least a second gap provides access to a fourth group of one or more wiring terminals of the electrical device in accordance with a second wiring configuration of the plurality of wiring configurations.

16. The apparatus of claim 15, wherein the visible indicia further provides information relating to wiring the electrical device according to the second wiring configuration.

17. The apparatus of claim 15, wherein the first edge of the substrate and the second edge of the substrate are opposite one another and separated by a width of the substrate.

18. An apparatus for use in wiring a physically separate electrical device during installation thereof at a point of operation, wherein the electrical device is capable of being wired in any one of a plurality of different wiring configurations, the apparatus comprising:

a portable, generally rectangular, non-conductive substrate defining a first plurality of tabs along a first edge and a second plurality of tabs along a second edge, the first plurality of tabs being separated by a first plurality of gaps such that each gap of the first plurality of gaps is defined by a distance separating a corresponding pair of the first plurality of tabs, the second plurality of tabs being separated by a second plurality of gaps such that each gap of the second plurality of gaps is defined by a distance separating a corresponding pair of the second plurality of tabs, the first plurality of tabs and the first plurality of gaps being arranged such that when the first edge of the substrate is positioned proximate the electrical device, the first plurality of tabs cover a first group of one or more wiring terminals of the electrical device and the first plurality of gaps provide access to a second group of one or more wiring terminals of the electrical device in accordance with a first wiring configuration of the plurality of wiring configurations, the second plurality of tabs and the second plurality of gaps being arranged such that when the second edge of the substrate is positioned proximate the electrical device, the second plurality of tabs cover a third group of one or more wiring terminals of the electrical device and the second plurality of gaps provide access to a fourth group of one or more wiring terminals of the electrical device in accordance with a second wiring configuration of the plurality of wiring configurations; and visible indicia disposed on the substrate and providing information relating to wiring the electrical device according to the first wiring configuration and the second wiring configuration.

19. The apparatus of claim 18, wherein the visible indicia is printed on at least one label that is adhered to the substrate.

20. The apparatus of claim 18, wherein the first edge of the substrate and the second edge of the substrate are opposite one another and separated by a width of the substrate.

* * * * *